US011453016B2

(12) United States Patent
Bartel et al.

(10) Patent No.: US 11,453,016 B2
(45) Date of Patent: *Sep. 27, 2022

(54) STACKED PRE-ORIFICES FOR SPRAYER NOZZLES

(71) Applicant: Engineered Spray Components LLC, Lexington, TN (US)

(72) Inventors: Mark Bartel, Lexington, TN (US); Gary Altom, Lexington, TN (US)

(73) Assignee: ENGINEERED SPRAY COMPONENTS LLC, Lexington, TN (US)

( * ) Notice: Subject to any disclaimer, the term of this patent is extended or adjusted under 35 U.S.C. 154(b) by 121 days.

This patent is subject to a terminal disclaimer.

(21) Appl. No.: 16/809,638

(22) Filed: Mar. 5, 2020

(65) Prior Publication Data

US 2020/0197957 A1 Jun. 25, 2020

Related U.S. Application Data

(63) Continuation-in-part of application No. 15/450,133, filed on Mar. 6, 2017, now Pat. No. 10,603,681.

(51) Int. Cl.
*B05B 1/02* (2006.01)

(52) U.S. Cl.
CPC ..... *B05B 1/02* (2013.01)

(58) Field of Classification Search
CPC . B05B 1/02–048; B05B 12/16; B05B 15/008; B05B 15/04; B05B 15/065; B05B 15/40; B05B 15/65; B05B 1/044; B05B 1/046; B05B 1/1048; B05B 1/042; A01M 7/006; A01M 7/005
USPC ..... 239/396, 397
See application file for complete search history.

(56) References Cited

U.S. PATENT DOCUMENTS 3,545,492 A * 12/1970 Scheid, Jr. ..... F16L 55/02718 138/42
3,784,111 A * 1/1974 Piggott ..... B64D 1/18 239/427.3
4,591,099 A * 5/1986 Emory ..... B05B 1/042 239/419

* cited by examiner

*Primary Examiner* — Tuongminh N Pham
*Assistant Examiner* — Juan C Barrera
(74) *Attorney, Agent, or Firm* — Dickinson Wright PLLC; Andrew D. Dorisio

(57) ABSTRACT

A multiple pre-orifice apparatus for a sprayer nozzle body with an upper end connected to a liquid source, a nozzle tip releasably mounted at a lower end thereof, and a channel between the upper and lower ends of the nozzle body. The apparatus comprises a sleeve assembly comprising a sleeve closed at an upper portion thereof by a top orifice plate defining a top orifice, and closed at a lower portion thereof by a bottom orifice plate defining a bottom orifice such that a sleeve turbulence chamber is formed between the top and bottom orifice plates. The sleeve assembly is secured in the channel such that a nozzle turbulence chamber is formed between the bottom orifice plate and the nozzle tip. The area of the flow opening in the nozzle tip is greater than the area of the top orifice which is greater than the area of the bottom orifice.

21 Claims, 2 Drawing Sheets

STACKED PRE-ORIFICES FOR SPRAYER NOZZLES

This disclosure relates to the field of spraying equipment and in particular a nozzle body apparatus for increasing the size of sprayed droplets to reduce spray drift.

BACKGROUND

There are many applications where it is necessary to spray a fluid material onto a target surface, often the ground. This application is notable for example in agriculture, horticulture and such things as golf course maintenance and pest control where chemicals are mixed with water and then sprayed on the ground, on plants growing from the ground, on bodies of water, and the like. Various fluids must also often be sprayed for example on roadways and in industrial applications to apply coatings and treatments to products passing by on a conveyor or the like.

Spraying is accomplished with sprayers, either self-propelled or towed units, and with aerial sprayers mounted on airplanes or helicopters. Such sprayers commonly comprise a tank of fluid, a pump for pressurizing and distributing the fluid to spray nozzles and means to control the fluid pressure. Sprayers typically have a plurality of nozzle bodies, each securing a spray nozzle tip, mounted on booms which swing in for transport and out for operation. Airplane mounted sprayers typically have a boom fixed to the wings.

The nozzle locations are spaced apart on a boom, perpendicular to the direction of travel, at a standard spacing distance which corresponds to the spray pattern of the nozzle tips. The same size nozzle tip is in operating position at each nozzle location, providing a consistent application rate across the width of the sprayer. Typically the nozzle tips are mounted in a nozzle body extending downward from the boom which carries the liquid agricultural products from the boom to the nozzle tips located in the bottom of the nozzle body. The nozzle body typically comprises an upper end connected to the boom and a channel extending downward to the nozzle tip mounted in the bottom end. A mesh strainer is commonly placed in the channel of the nozzle body between the nozzle tip and the boom. A typical strainer is provided by a hollow cylinder with wire mesh walls. Such a strainer and nozzle body is disclosed in U.S. Pat. No. 8,936,207 to Swan.

A problem with applying agricultural products such as herbicides is that even moderate air movement from wind, thermal conditions, and the like, can move the chemicals from the field being sprayed onto adjacent fields and, especially where the adjacent crop is of a different type and susceptible to the chemicals being sprayed, cause serious damage. Where fields are adjacent to urban or like otherwise occupied areas health issues also arise. This "drift" of chemicals is significantly affected by the size of the droplets being sprayed, with larger droplets being less susceptible to drift than smaller droplets. Conversely, it is generally the case that smaller droplets provide a better plant coverage than larger droplets, with corresponding increased efficacy in achieving the products aim, such as killing undesirable plants and weeds in the case of a herbicide.

Government regulations in some jurisdictions require a "label" on agricultural chemical products that indicates the conditions under which the product may be used, including the required application details such as limited environmental conditions, nozzles, nozzle droplet size classifications (droplet sizes), no spray zones, buffer zones, and other application details.

United States Published Patent Application Number 2008/0087745 of Pearson et al. discloses an air induction nozzle assembly for reducing the number fine small droplets dispensed from a sprayer nozzle. The assembly draws ambient air into the liquid flow stream for stabilizing the liquid prior to discharge from the nozzle.

U.S. Pat. No. 3,934,823 to Reed discloses angled tangential pre-orifices to impart a swirl to the swirl chamber which sprays into a second swirl chamber where the liquid appears to mix with air drawn into the chamber through the center of the hollow cone spray pattern dispensed from the nozzle tip which pattern comprises droplets of an increased size.

It is also known to provide a pre-orifice in the nozzle body above the nozzle tip. The pre-orifice device defines a hole which has a smaller flow rate than the nozzle tip and so controls the rate of flow and reduces the pressure at the nozzle tip so that larger droplets are dispensed from the nozzle tip. Wilger Inc. of Lexington, Tenn. makes and sells such pre-orifice devices that fit into the channel of the nozzle body between the nozzle tip and the boom, in the same location as the mesh strainer.

Similar problems occur in industrial applications where small droplets can fog and move off target onto machinery and surrounding areas.

SUMMARY OF THE INVENTION

The present disclosure provides a multiple pre-orifice apparatus for a sprayer nozzle body that overcomes problems in the prior art.

The present disclosure provides a multiple pre-orifice apparatus for a sprayer nozzle body where the nozzle body connected to a liquid source to receive liquid to be sprayed, a nozzle tip releasably mounted thereto, and a channel between the ends of the nozzle body. The apparatus comprises a sleeve assembly comprising a sleeve closed at a first portion thereof by a first orifice plate defining a first orifice, and closed at a second portion thereof by a second orifice plate defining a second orifice such that a sleeve turbulence chamber is formed between the first and second orifice plates. The sleeve assembly is configured to be secured in the channel such that, when secured, a nozzle turbulence chamber is formed between the second orifice plate and the nozzle tip. An area of the first orifice is greater than an area of the second orifice, and an area of a flow opening in the nozzle tip is greater than the area of the first orifice.

The present disclosure provides a multiple pre-orifice apparatus that is readily installed in existing nozzle bodies used in agricultural spray equipment and where turbulence is generated in the sleeve and nozzle turbulence chambers. Providing multiple turbulence chambers and orifices increases the turbulence encountered by liquid passing therethrough and increases the occurrence of smaller drops amalgamating to form more desirable larger drops. Changing the configuration of the orifices and turbulence chambers along the width of a sprayer boom can increase the size of drops sprayed to a degree corresponding to the risk of drift out of the spray area at the particular location on the boom.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
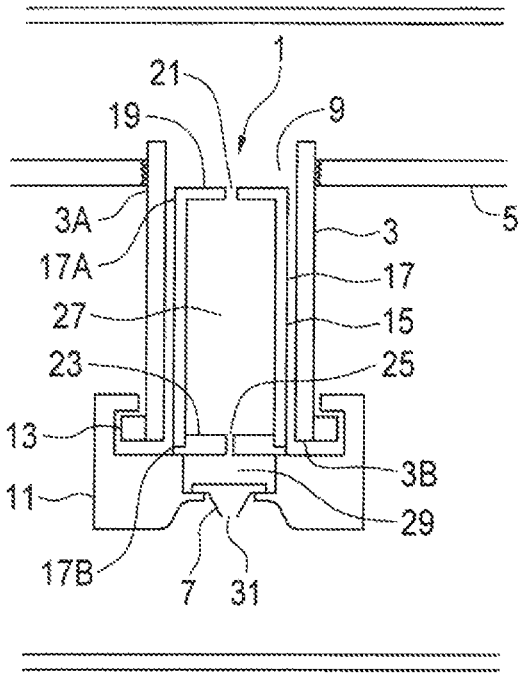
FIG. 1 is an assembled schematic sectional front view of an embodiment of the multiple pre-orifice apparatus of the present disclosure.
Figure 2:
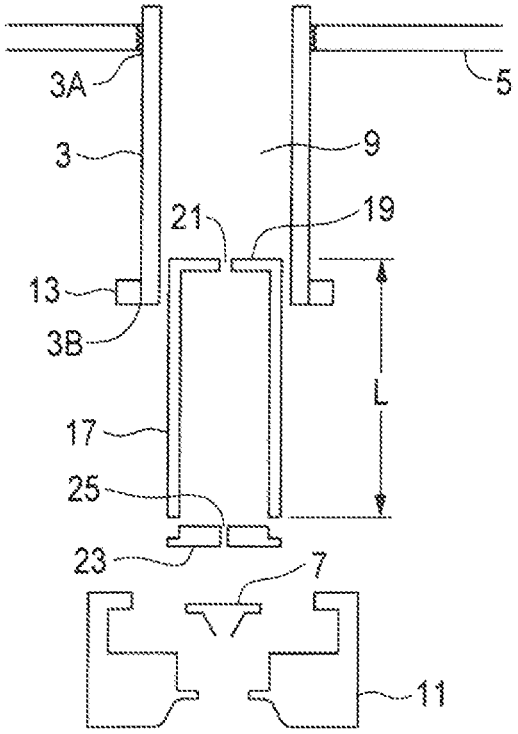
FIG. 2 is an exploded sectional front view of the embodiment of FIG. 1.

FIGS. 1 and 2 schematically illustrate an embodiment of a multiple pre-orifice apparatus 1 of the present disclosure for a sprayer nozzle body 3. The nozzle body 3 comprises an upper end 3A connected to a liquid source, illustrated as a sprayer boom 5, to receive liquid to be sprayed, such as an agricultural chemical. A nozzle tip 7 is releasably mounted at a lower end 3B of the nozzle body 3, and the nozzle body 3 forms a channel 9 between the upper and lower ends 3A, 3B thereof. As is known in the art the nozzle tip 7 is mounted to the lower end 3B of the nozzle body 3 by a cap 11 engaging lugs 13 extending from the lower end 3B of the nozzle body 3. The nozzle body 3, nozzle tip 7, and cap 11 may be conventional of a style and configuration used in the industry.

The apparatus 1 comprises a sleeve assembly 15 comprising a sleeve 17 closed at a top end 17A thereof by a top orifice plate 19 defining a top orifice 21, and closed at a bottom end 17B thereof by a bottom orifice plate 23 defining a bottom orifice 25 such that a sleeve turbulence chamber 27 is formed between the top and bottom orifice plates 19, 23. In the apparatus 1 the top and bottom orifices 21, 25 are circular and are located in centers of the corresponding top and bottom orifice plates 19, 23. The sleeve assembly 15 is configured to be secured in the channel 9 such that, when secured, a nozzle turbulence chamber 29 is formed between the bottom orifice plate 23 and the nozzle tip 7. The illustrated top and bottom orifice plates 19, 23 are shown at the ends of the sleeve 17, but can also be placed in upper and lower portions of the sleeve to vary a length of the sleeve and nozzle turbulence chambers 27, 29.

The diameter and the corresponding area of the top orifice 21 is greater than the diameter and corresponding area of the bottom orifice 25. In many nozzle tips the flow opening 31 in the nozzle tip is not circular as are the top and bottom orifices 21, 25 but is shaped to provide the desired spray pattern. In any event the area of the flow opening 31 is greater than the area of the top orifice 21. With the smaller orifices 21, 25 the flow rate of liquid through the sleeve assembly 15 at any given pressure is less than the flow rate of liquid would be through the flow opening 31 in the nozzle tip 7 at the same pressure.

There is then a pressure drop between the liquid pressure at the sprayer boom 5 and the liquid pressure in the nozzle turbulence chamber 29. Liquid passing through the top orifice 21 sprays into the sleeve turbulence chamber 27 creating turbulence which causes fine drops to combine and thereby increases the size of the drops, and the liquid then sprays through the bottom orifice 25 into the nozzle turbulence chamber 29 again creating turbulence and again the drops further combine to again increase the size of the drops The relative diameter of the two orifices 21, 25, the size of the flow opening 31 in the nozzle tip 7 and diameter and length of the sleeve and nozzle turbulence chambers 27, 29 can be adjusted to produce different levels of drift reduction. In an application where the bottom orifice plate 23 is mounted at the bottom of the sleeve 17, the length of the nozzle turbulence chamber 29 is dictated by the configuration of the particular nozzle body 3 and cap 11 however this can be adjusted as well by adjusting the position of the bottom orifice plate 23 with respect to the nozzle tip 7.

Figure 3:
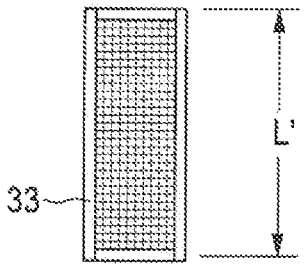
FIG. 3 is a schematic front view of a strainer assembly that can conventionally be placed in the channel of the nozzle body of FIG. 1.

Also commonly the conventional nozzle body 3 will include a strainer assembly 33, schematically illustrated in FIG. 3, in the channel 9. Such strainer assemblies typically comprise a mesh screen configured such that liquid passing from the liquid source 5 to the nozzle tip 7 passes through the mesh screen. The sleeve assembly has a length L that is substantially equal to or less than the length L' of the strainer assembly 33 such that the strainer assembly 33 can be removed from the channel 9 and replaced with the sleeve assembly 15.

Figure 4:
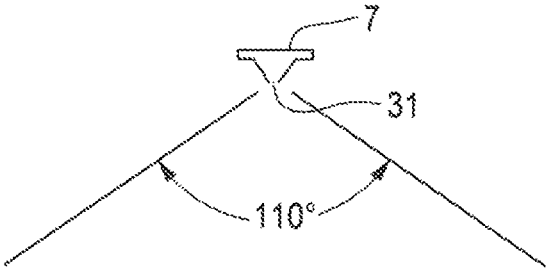
FIG. 4 is a schematic front view of the nozzle tip of the embodiment of FIG. 1 showing the spray pattern dispensed.

For example a common nozzle tip 7 used in agricultural spray applications is configured as schematically illustrated in FIG. 4 to dispense a 110 degree flat fan spray pattern. The size of the flow opening 31 will vary according to the dispensing rate desired for the particular application. In use with such a nozzle tip 7, the diameter of the top orifice will be about 1.75 times the diameter of the bottom orifice 25. Thus the area of the top orifice 21 will be about three times the area of the bottom orifice 25 and the size of the top and bottom orifices 21, 25 will be selected according to the dispensing flow rate of the flow opening 31 in the nozzle tip 7, such that the flow rate through the flow opening 31 is about 2.5 to 3.5 times a flow rate through the sleeve assembly 15. The length of the sleeve turbulence chamber 27 between the top and bottom orifices 21, 25 is between about 0.125 inches to 1.0 inches and more preferably between about 0.525 inches and about 0.850 inches. Generally speaking for lower flow rates the spacing distance will be less than for higher flow rates.

Thus for use with a common UR110-05 nozzle tip with a flow rate of 0.5 USgal/min at 40 psi the diameter of the top orifice 21 is 0.1094" and the diameter of the bottom orifice 21 is 0.0625". The length of the sleeve turbulence chamber 27 between the top and bottom orifices 21, 25 is about 0.85 inches for the UR110-05 nozzle tip. Depending on the sprayer tip used and the degree of droplet size increase the length of the sleeve turbulence chamber typically will be 0.125 inches to 1.0 inches, and preferably about 0.525 inches to 0.85 inches.

Figure 5:
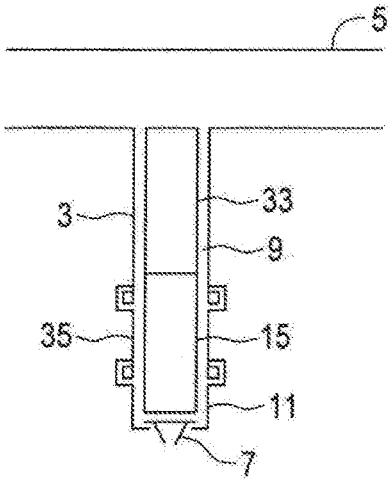
FIG. 5 is a schematic sectional front view of the embodiment of FIG. 1 with a body extension member attached between the nozzle body and the nozzle tip to extend a length of the channel in the nozzle body.

FIG. 5 schematically illustrates a body extension member 35 adapted to attach, as illustrated, to the bottom end 3B of the nozzle body 3 between the nozzle body 3 and the nozzle tip 7 to extend a length of the channel 9. The longer channel can be useful in some situations, such as where, for example, it is desired to use a strainer assembly 33 with the sleeve assembly 15. The illustrated strainer assembly 33 is configured to be inserted into the channel 9 before the sleeve assembly 15 such that the strainer assembly 33 is above the sleeve assembly 15.

Figure 6:
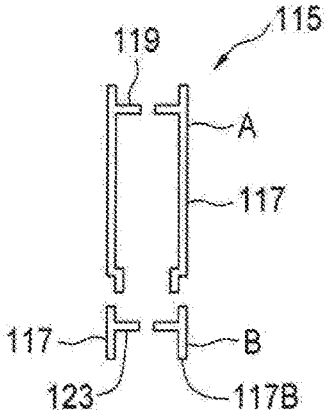
FIG. 6 is a schematic sectional front view of an alternate sleeve assembly where the sleeve, top orifice plate, and bottom orifice plate are molded in two pieces that snap together to create the sleeve assembly.
Figure 7:
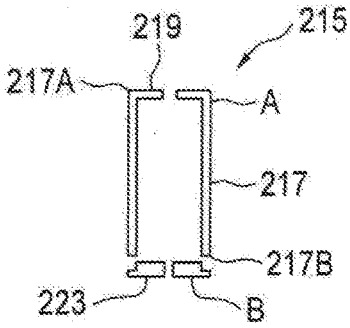
FIG. 7 is a schematic sectional front view of a further alternate sleeve assembly where the sleeve, top orifice plate, and bottom orifice plate are molded in two pieces that snap together to create the sleeve assembly.

The relative lengths of the sleeve and nozzle turbulence chambers 27, 29 can be adjusted by moving the top and bottom orifice plates 19, 23. FIGS. 6 and 7 schematically illustrate sleeve assemblies 115 and 215 where the sleeve 117, 217, top orifice plate 119, 219, and bottom orifice plate 123, 223 are molded in two pieces A and B that snap together to create the sleeve assembly 115, 215. It is contemplated as well that the sleeve assembly could be in three pieces with a detachable orifice plate on each end.

In the sleeve assembly 115 of FIG. 6 portions of the sleeve 217 are defined by both pieces A and B, and the bottom orifice plate 123 is above the bottom end 117B of the sleeve 117, and also the top orifice plate 119 is below the top end 117A of the sleeve 117. In the sleeve assembly 215 of FIG. 7 top orifice plate 219 is at the top end 217A of the sleeve 217 and the bottom orifice plate 223 is provided by the piece B which snaps into the bottom end 217B of the sleeve 217.

Other configurations can be used to vary the length of the sleeve and nozzle turbulence chambers as desired.

Figure 8:
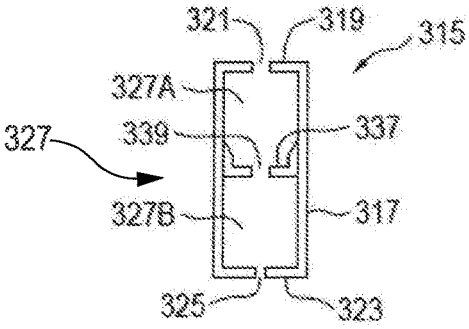
FIG. 8 is a schematic sectional front view of a further alternate sleeve assembly with a middle orifice plate extending across an interior of the sleeve between the top and bottom orifice plates such that the sleeve turbulence chamber is divided into an upper chamber and a lower chamber.

FIG. 8 schematically illustrates a sleeve assembly 315 with a middle orifice plate 337 extending across an interior of the sleeve 317 between the top and bottom orifice plates 319, 323 such that the sleeve turbulence chamber 327 is divided into an upper chamber 327A and a lower chamber 327B. The middle orifice plate 337 defines a middle orifice 339 with an area that is less than the area of the top orifice 321 defined by the top orifice plate 319 and greater than the area of the bottom orifice 325 defined by the bottom orifice plate 323.

Figure 9:
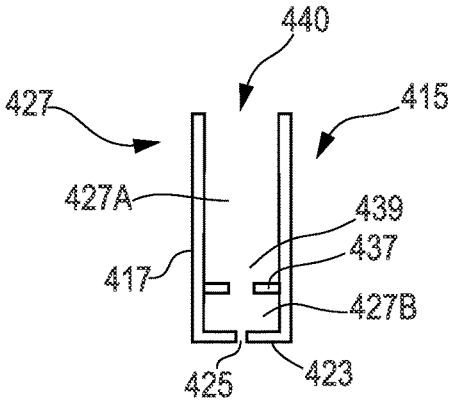
FIG. 9 is a schematic sectional front view of a further alternate sleeve assembly.

FIG. 9 schematically illustrates a sleeve assembly 415 with a first, upper orifice plate 437 extending across an interior of the sleeve 417 above a second, lower orifice plate 423 such that the sleeve turbulence chamber 427 with substantially straight parallel walls is formed between the first and second orifice plates 437, 423, and is divided into an upper chamber 427A and a lower chamber 427B. The first orifice plate 437 defines a first orifice 439 with an area that is greater than the area of a second orifice 425 defined by the second orifice plate 423. The sleeve 417 also has an open (upper) end 440. In one particular example where the length of the sleeve turbulence chamber 427 is about 0.85 inches, and the first orifice plate 437 is about 0.63 inches from the open upper end 440, and thus the space between the first and second orifice plates 437, 423 is about 0.145 inches. It can also be appreciated that both plates 437, 423 are located in a lower portion of the sleeve 417.

The present disclosure provides a multiple pre-orifice apparatus 1 that is readily installed in existing nozzle bodies 3 used in agricultural spray equipment. Providing multiple chambers and orifices increases the turbulence encountered by liquid passing therethrough and increases the occurrence of smaller drops amalgamating to form more desirable drops. Changing the configuration of the orifices 21, 25 and chambers 27, 29 along the width of a sprayer boom can increase the size of drops sprayed to a degree corresponding to the risk of drift out of the spray area at the particular location on the boom.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A multiple pre-orifice spraying apparatus for spraying an agricultural chemical, the apparatus comprising:

a sprayer nozzle body comprising a first end connected to a liquid source to receive liquid to be sprayed, a nozzle tip releasably mounted at a second end thereof, a channel between the first and second ends of the sprayer nozzle body, the sprayer nozzle body including a continuous sidewall lacking any aperture;

a sleeve assembly comprising a sleeve including a substantially flat first orifice plate defining a first orifice, and spaced apart from a substantially flat second orifice plate defining a second orifice such that a sleeve turbulence chamber with substantially straight parallel walls is formed between the first and second orifice plates;

wherein the sleeve assembly is configured to be secured in the channel such that, when secured, a nozzle turbulence chamber with substantially straight parallel walls is formed between the first orifice plate and the nozzle tip and the first orifice plate and the second orifice plate are substantially perpendicular to the straight parallel walls;

wherein an area of the first orifice is greater than an area of the second orifice, and an area of a flow opening in the nozzle tip is greater than the area of the first orifice;

wherein the first orifice, the second orifice, and the flow opening in the nozzle tip are aligned; and whereby the nozzle body and sleeve assembly are capable of causing droplets of the liquid exiting the flow opening in the nozzle tip with the sleeve assembly in place to have an increased droplet size compared to droplets of the liquid exiting the flow opening in the nozzle tip when the sleeve assembly is removed.

2. The apparatus of claim 1 wherein the sprayer nozzle body comprises a strainer assembly in the channel and wherein the sleeve assembly has a length that is substantially equal to or less than a length of the strainer assembly such that the strainer assembly can be removed from the channel and replaced with the sleeve assembly.

3. The apparatus of claim 1 wherein the sleeve, first orifice plate, and second orifice plate are molded in two pieces that snap together to create the sleeve assembly.

4. The apparatus of claim 1 wherein the second orifice plate is above a bottom end of the sleeve, or the first orifice plate is below a first end of the sleeve.

5. The apparatus of claim 1 wherein the nozzle tip is configured to dispense a flat fan spray pattern, and wherein the area of the first orifice is three times the area of the second orifice.

6. The apparatus of claim 5 wherein a flow rate through the flow opening in the nozzle tip is 2.5 to 3.5 times a flow rate through the sleeve assembly.

7. The apparatus of claim 6 wherein the nozzle tip is configured to dispense a 110 degree flat fan spray pattern.

8. The apparatus of claim 7 wherein a length of the sleeve turbulence chamber between the first and second orifice plates is between 0.125 inches and 1.000 inches.

9. The apparatus of claim 8 wherein the length of the sleeve turbulence chamber between the first and second orifice plates is between 0.525 inches and 0.85 inches.

10. The apparatus of claim 1 further comprising a body extension member adapted to attach to a second end of the nozzle body between the nozzle body and the nozzle tip to extend a length of the channel.

11. The apparatus of claim 10 further comprising a strainer assembly configured to be inserted into the channel, the strainer member comprising a mesh screen configured such that liquid passing from the liquid source to the nozzle tip passes through the mesh screen.

12. The apparatus of claim 11 wherein the strainer assembly is configured to be inserted into the channel before the sleeve assembly such that the strainer assembly is above the sleeve assembly.

13. The apparatus of claim 10 wherein the sleeve assembly comprises a strainer section above the first orifice plate; the strainer section comprising a mesh screen configured such that liquid passing from the liquid source to the first orifice passes through the mesh screen.

14. The apparatus of claim 1 further comprising a third orifice plate extending across an interior of the sleeve between the first and second orifice plates such that the sleeve turbulence chamber is divided into a first chamber and a second chamber, and wherein the third orifice plate defines a third orifice with an area that is less than the area of the first orifice and greater than the area of the second orifice and wherein the first orifice, the second orifice, the third orifice, and the flow opening in the nozzle tip are aligned.

15. The apparatus of claim 1 wherein at least one of the first and second orifices is circular.

16. The apparatus of claim 15 wherein the first and second orifices are located substantially in centers of the corresponding first and second orifice plates.

17. The apparatus of claim 1, wherein the first and second orifice plates are located in a lower portion of the sleeve.

18. The apparatus of claim 1, wherein the first and second orifice plates are spaced apart a first distance less than a second distance from an open end of the sleeve to the first orifice plate.

19. The apparatus of claim 1, wherein the first and second orifice plates are spaced apart about 0.145 inches.

20. A multiple pre-orifice spraying apparatus for spraying an agricultural chemical, the apparatus comprising:

a sprayer nozzle body comprising a first end connected to a liquid source to receive liquid to be sprayed, a nozzle tip releasably mounted at a second end thereof, and a channel between the first and second ends of the sprayer nozzle body, the sprayer nozzle body including a continuous sidewall lacking any aperture;

a sleeve assembly comprising a sleeve including a substantially flat first orifice plate defining a first orifice, and spaced apart from a substantially flat second orifice plate defining a second orifice such that a sleeve turbulence chamber with substantially straight parallel walls is formed between the first and second orifice plates;

wherein the sleeve assembly is configured to be secured in the channel such that, when secured, a nozzle turbulence chamber with substantially straight parallel walls is formed between the first orifice plate and the nozzle tip and the first orifice plate and the second orifice plate are substantially perpendicular to the straight parallel walls;

wherein an area of the first orifice is greater than an area of the second orifice, and an area of a flow opening in the nozzle tip is greater than the area of the first orifice;

wherein the first orifice, the second orifice, and the flow opening in the nozzle tip are aligned;

wherein the first and second orifice plates are located in a lower portion of the sleeve; and whereby the nozzle body and sleeve assembly are capable of causing droplets of the liquid exiting the flow opening in the nozzle tip with the sleeve assembly in place to have an increased droplet size compared to droplets of the liquid exiting the flow opening in the nozzle tip when the sleeve assembly is removed.

21. A multiple pre-orifice spraying apparatus for spraying an agricultural chemical, the apparatus comprising:

a sprayer nozzle body comprising a first end connected to a liquid source to receive liquid to be sprayed, a nozzle tip releasably mounted at a second end thereof, and a channel between the first and second ends of the sprayer nozzle body, the sprayer nozzle body including a continuous sidewall lacking any aperture;

a sleeve assembly comprising a sleeve including a substantially flat first orifice plate defining a first orifice, and spaced apart from a substantially flat second orifice plate defining a second orifice such that a sleeve turbulence chamber with substantially straight parallel walls is formed between the first and second orifice plates;

wherein the sleeve assembly is configured to be secured in the channel such that, when secured, a nozzle turbulence chamber with substantially straight parallel walls is formed between the first orifice plate and the nozzle tip and the first orifice plate and the second orifice plate are substantially perpendicular to the straight parallel walls;

wherein an area of the first orifice is greater than an area of the second orifice, and an area of a flow opening in the nozzle tip is greater than the area of the first orifice;

wherein the first orifice, the second orifice, and the flow opening in the nozzle tip are aligned;

wherein the first and second orifice plates are located in a lower half of the sleeve; and whereby the nozzle body and sleeve assembly are capable of causing droplets of the liquid exiting the flow opening in the nozzle tip with the sleeve assembly in place to have an increased droplet size compared to droplets of the liquid exiting the flow opening in the nozzle tip when the sleeve assembly is removed.

* * * * *